US010138028B2

(12) United States Patent
Huang

(10) Patent No.: US 10,138,028 B2
(45) Date of Patent: Nov. 27, 2018

(54) SELF-PRIMING-PUMP EQUIPPED PACKAGING BOTTLE

(71) Applicant: ANHUI JND PLASTIC PACKAGING CO., LTD., Huainan (CN)

(72) Inventor: Yi Xin Huang, Huainan (CN)

(73) Assignee: ANHUI JND PLASTIC PACKAGING CO., LTD., Huainan (CN)

( * ) Notice: Subject to any disclaimer, the term of this patent is extended or adjusted under 35 U.S.C. 154(b) by 0 days.

(21) Appl. No.: 15/602,180

(22) Filed: May 23, 2017

(65) Prior Publication Data

US 2018/0002073 A1 Jan. 4, 2018

(30) Foreign Application Priority Data

Jul. 4, 2016 (CN) ..... 2016 1 0517732

(51) Int. Cl.

| | |
|---|---|
| ***B65D 41/00*** | (2006.01) |
| ***B65D 53/04*** | (2006.01) |
| ***B65D 83/00*** | (2006.01) |
| ***B65D 1/02*** | (2006.01) |
| ***B65D 47/00*** | (2006.01) |
| ***B05B 11/00*** | (2006.01) |

(52) U.S. Cl.

CPC ..... *B65D 41/005* (2013.01); *B05B 11/3028* (2013.01); *B05B 11/3053* (2013.01); *B65D 1/0261* (2013.01); *B65D 47/00* (2013.01); *B65D 53/04* (2013.01); *B65D 83/0005* (2013.01); *B05B 11/00416* (2018.08); *B05B 11/3029* (2013.01); *B05B 11/3069* (2013.01)

(58) Field of Classification Search

CPC .... B65D 41/005; B65D 47/00; B65D 1/0261; B65D 53/04

USPC ..... 222/386

See application file for complete search history.

(56) References Cited

U.S. PATENT DOCUMENTS 4,685,594 A * 8/1987 Czech ..... B05B 11/0048 222/182
4,809,887 A * 3/1989 Jupin ..... A47K 5/1201 222/207
4,892,231 A * 1/1990 Ball ..... A47K 5/1201 222/207

(Continued)

*Primary Examiner* — Donnell Long
(74) *Attorney, Agent, or Firm* — Gokalp Bayramoglu

(57) ABSTRACT

A self-priming-pump-equipped packaging bottle includes a tubular bottle body containing therein an upper seal assembly, a lower seal assembly, and piston from top to bottom. The upper and lower seal assemblies and the tubular bottle body form a closed material-feeding chamber. The lower seal assembly, the piston, and the tubular bottle body form a closed material-storing chamber. The lower seal assembly primarily has a seal seat with a through hole and an elastic sealing gasket covering the through hole from above. The upper seal assembly has an umbrella-shaped member, a hollow material-feeding column, a support post, and an end sealing cap. The end sealing cap is fixed in the umbrella-shaped member through the support post. The hollow material-feeding column's bottom surface, the support post, and the end sealing cap form a material outlet. The umbrella-shaped member lower end is in interference fit with the seal seat.

9 Claims, 15 Drawing Sheets

(56) References Cited

U.S. PATENT DOCUMENTS

| | | | | |
|---|---|---|---|---|
| 8,240,518 | B2 * | 8/2012 | Canfield | A45D 34/04 222/105 |
| 2009/0065531 | A1 * | 3/2009 | Decottignies | B05B 11/3028 222/207 |
| 2013/0008924 | A1 * | 1/2013 | Lafosse | B05B 11/0013 222/256 |

* cited by examiner

SELF-PRIMING-PUMP EQUIPPED PACKAGING BOTTLE

BACKGROUND OF THE INVENTION

1. Technical Field

The present invention related to packaging, and more particularly to a self-priming-pump-equipped packaging bottle.

2. Description of Related Art

With the continuous progress of technology and society, articles for daily use are more and more required to be made with innovation. People select products based on their packaging as much as on their quality. Packaging needs to be not only a simple container, but also a device that has attractive appearance and is convenient to use. Among packaging bottles for commodities, press-type packaging bottles are most extensively used. A known press-type bottles is typically made of a pipe, a spring, and a piston, and has problems related to complicated structure and high manufacturing costs. As an alternative, China Patent No. CN201619795U discloses a pump-type packaging bottle. However, due to the lack of airtightness between the bottle's piston and the bottle's body, the piston is prevented from moving upward timely, leading to instable material feeding. Another packaging bottle is proposed in China Patent No. CN102502060A as a solution. Nevertheless, the negative-pressure packaging bottle tends to fall apart in use because the combination between the pump and the bottle's body is not firm enough. Thus, the prior-art packaging bottles are not perfect and need to be improved.

SUMMARY OF THE INVENTION

An objective of the present invention is to provide a self-priming-pump-equipped packaging bottle.

For achieving the foregoing objective, the present invention adopts the technical scheme as described below:

A self-priming-pump-equipped packaging bottle, comprising: a tubular bottle body, a piston, an upper seal assembly, and a lower seal assembly; the piston being installed in a lower part of the tubular bottle body; the upper seal assembly being fixed in an upper part of the tubular bottle body; the lower seal assembly being fixed in a middle part of the tubular bottle body between the piston and the upper seal assembly; the upper seal assembly, the lower seal assembly and the tubular bottle body jointly forming a closed material-feeding chamber; and the lower seal assembly, the piston, and the tubular bottle body jointly forming a closed material-storing chamber;

the lower seal assembly including a seal seat and an elastic sealing gasket, the seal seat having a through hole communicating the material-feeding chamber and the material-storing chamber, the elastic sealing gasket covering the through hole from a side corresponding to the material-feeding chamber; and the seal seat is in connection with the tubular bottle body; and the upper seal assembly having an umbrella-shaped member, a hollow material-feeding column, a support post, and an end sealing cap; the end sealing cap being fixed inside the umbrella-shaped member through the support post; an outer wall of the hollow material-feeding column closely fitting the support post and extending inward from an opening at an upper end of the umbrella-shaped member; a bottom surface of the hollow material-feeding column, the support post, and the end sealing cap jointly forming a material outlet; and a lower end of the umbrella-shaped member being in interference fit with the seal seat.

In an initial state, the cap of the material outlet tube that is connected to the upper surface of the button closes the opening of the material outlet tube. In the upper seal assembly, the end sealing cap inside the umbrella-shaped member closely fits the bottom of the material outlet tube, so that the material outlet is blocked. In the lower seal assembly, the elastic sealing gasket naturally lies on the through hole of the seal seat, so that the material-storing chamber is isolated from the material-feeding chamber.

In use, when the button of the pump head is pressed, the cap of the material outlet tube connected to the upper surface of the button is opened, and the applied pressure acts on the umbrella-shaped member through the button. As a result, the umbrella-shaped member deforms in the direction where the pressure is applied, making the end sealing cap of the umbrella-shaped member move downward, so that the bottom of the material outlet tube and the end sealing cap become separated from their original close-fit status, and the material outlet is opened. At this time, the material in the material-feeding chamber is extruded through the material outlet, the hollow material-feeding column, and the material outlet tube. Meanwhile, the deformation of the umbrella-shaped member makes the seal plate in the elastic sealing gasket move downward, thereby sealing the through hole of the seal seat, and isolating the material-storing chamber from the material-feeding chamber.

When the button is released, the cap of the material outlet tube closes the opening of the material outlet tube again, and the umbrella-shaped member, which is now freed from the compression, preforms deformation recovery. As a result, the umbrella-shaped member moves upward, and the bottom of the material outlet tube closely fits the end sealing cap again to block the material outlet. At this time, negative pressure occurs in the material-feeding chamber, and makes the seal plate in the elastic sealing gasket move upward. Consequently, the through hole of the seal seat is opened, and material enters the material-feeding chamber from the material-storing chamber via the through hole. In this process, the piston moves upward with the material. When the air pressure in the material-storing chamber and the air pressure in the material-feeding chamber become balanced, the piston stops moving. After being still for a period of time, the seal plate in the elastic sealing gasket is pulled to return by the connecting strip, so that the elastic sealing gasket naturally closes the seal seat 4, and the entire device returns to its initial state.

Some preferred technical schemes are as below.

In the self-priming-pump-equipped packaging bottle as described previously, the tubular bottle body is a tube-shaped bottle body, and the piston is a sealing member having a waist-shaped cross-section, in which the piston and an inner wall of the tubular bottle body closely fit.

In the self-priming-pump-equipped packaging bottle as described previously, the elastic sealing gasket includes a circular ring, a seal plate located at a center of the circular ring, and a connecting strip that connects the circular ring and the seal plate, in which the circular ring, the seal plate, and the connecting strip are integrated as a unit, and the seal plate is smaller than the circular ring in terms of thickness.

In the self-priming-pump-equipped packaging bottle as described previously, the circular ring has a rectangular physical cross-section, and the seal plate is a round plate, while the connecting strip is a curved band, in which the connecting ship has a radius of are 2-5 mm greater than a radius of circle of the seal plate, and a joint between the connecting strip and the seal plate is a bend.

In the self-priming-pump-equipped packaging bottle as described previously, the seal seat is provided therein with a circular recessed step that includes and has a circular ring fixed inside the seal seat, in which the through hole is centrally formed on the seal seat, and a seal plate of the elastic sealing gasket is located centrally, with the seal plate being greater than the through hole in size, and with the connection realized by interference fit or fixed connection. The seal seat and the tubular bottle body may be made integratedly as a unity by means of one-step injection molding.

In the self-priming-pump-equipped packaging bottle as described previously, the umbrella-shaped member is an elastic body, whose upper part is of a hollow columnar structure, and whose lower part is of an umbrella-shaped structure, in which a top surface of the umbrella-shaped structure is provided with more thian three ribs.

In the self-priming-pump-equipped packaging bottle as described previously, the hollow material-feeding column has a height smaller than a length of the support post, and the support post includes four evenly distributed studs, in which each said stud has one end connected to the end seeding cap, and an opposite end connected to the opening at the upper end of the umbrella-shaped member, while the umbrella-shaped member, the hollow material-feeding column, the support post, and the end sealing cap are integrated as a unity.

In the self-priming-pump-equipped packaging bottle as described previously, the interference fit between the lower end of the umbrella-shaped member and the seal seat is interference fit between an edge of an opening at the lower end of the umbrella-shaped member and a circular recessed step in the seal seat.

In the self-priming-pump-equipped packaging bottle as described previously, there is further a pump head that includes a button and a material outlet tube, wherein an upper surface of the button is connected to a cap of the material outlet tube that covers an opening of the material outlet tube, in which the material outlet tube is connected to the hollow material-feeding column, and an outer diameter of the material outlet tube is equal to an inner diameter of the hollow material-feeding column.

In the self-priming-pump-equipped packaging bottle as described previously, the self-priming-pump-equipped packaging bottle has a bottom thereof provided with a base that is provided with more than one through hole connecting the packaging bottle and the atmosphere.

The present invention has the following beneficial effects:

1) the present invention realizes automatic dispatch of material using a device that is structurally simple, economic to produce and convenient to use;

2) the components in the present invention are compact and reliable, thereby ensuring stable material feeding;

3) the components in the present invention are assembled firmly and unlikely to fall apart in use; and 4) the present invention is esthetics and can be extensively used in various applications.

DETAILED DESCRIPTION OF THE INVENTION

The present invention will be described with reference to some preferred embodiments and it is understood that the embodiments are only illustrative and not intended to limit the scope of the present invention. Moreover, as the contents disclosed herein should be readily understood and can be implemented by a person skilled in the art, all equivalent changes or modifications which do not depart from the concept of the present invention should be encompassed by the appended claims.

Figure 1:
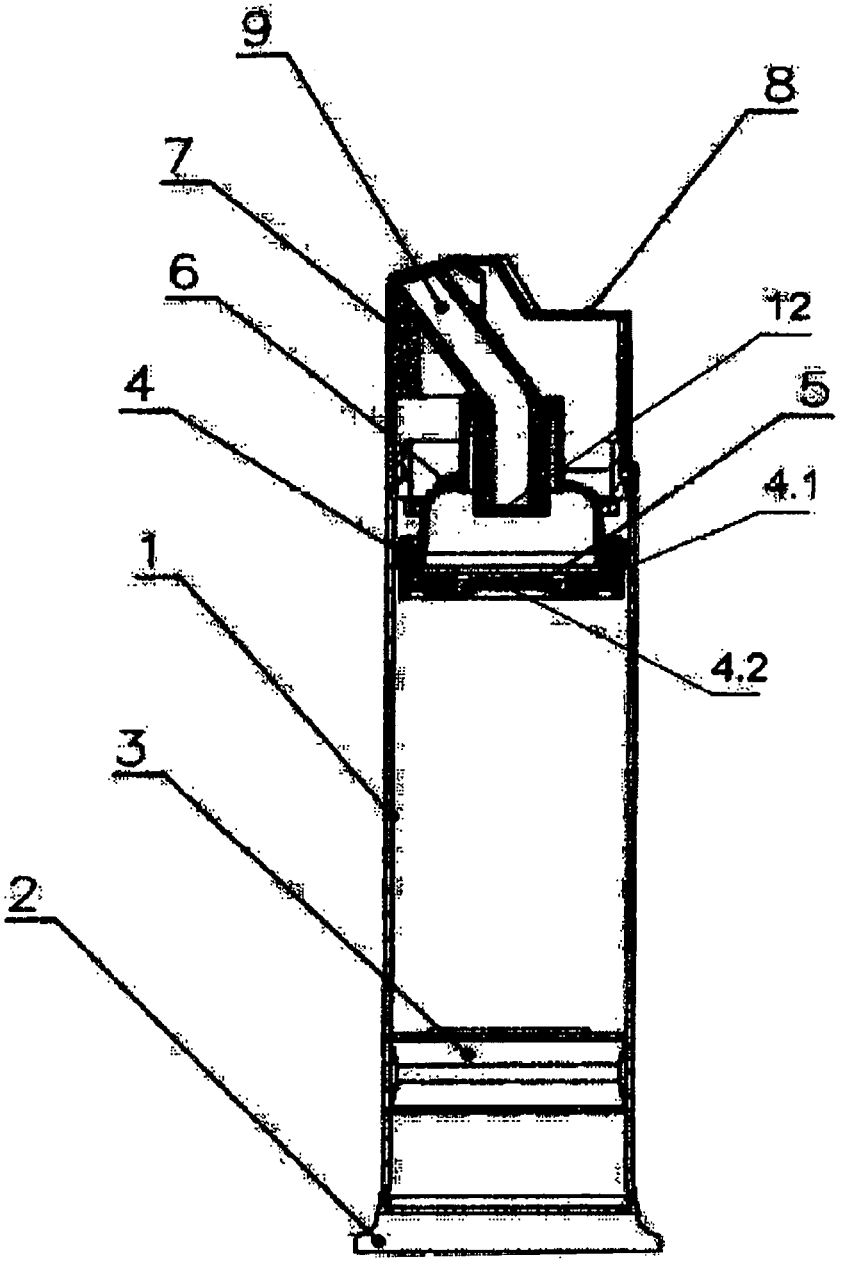
FIG. 1 is a cross-sectional view of the present invention.
Figure 2:
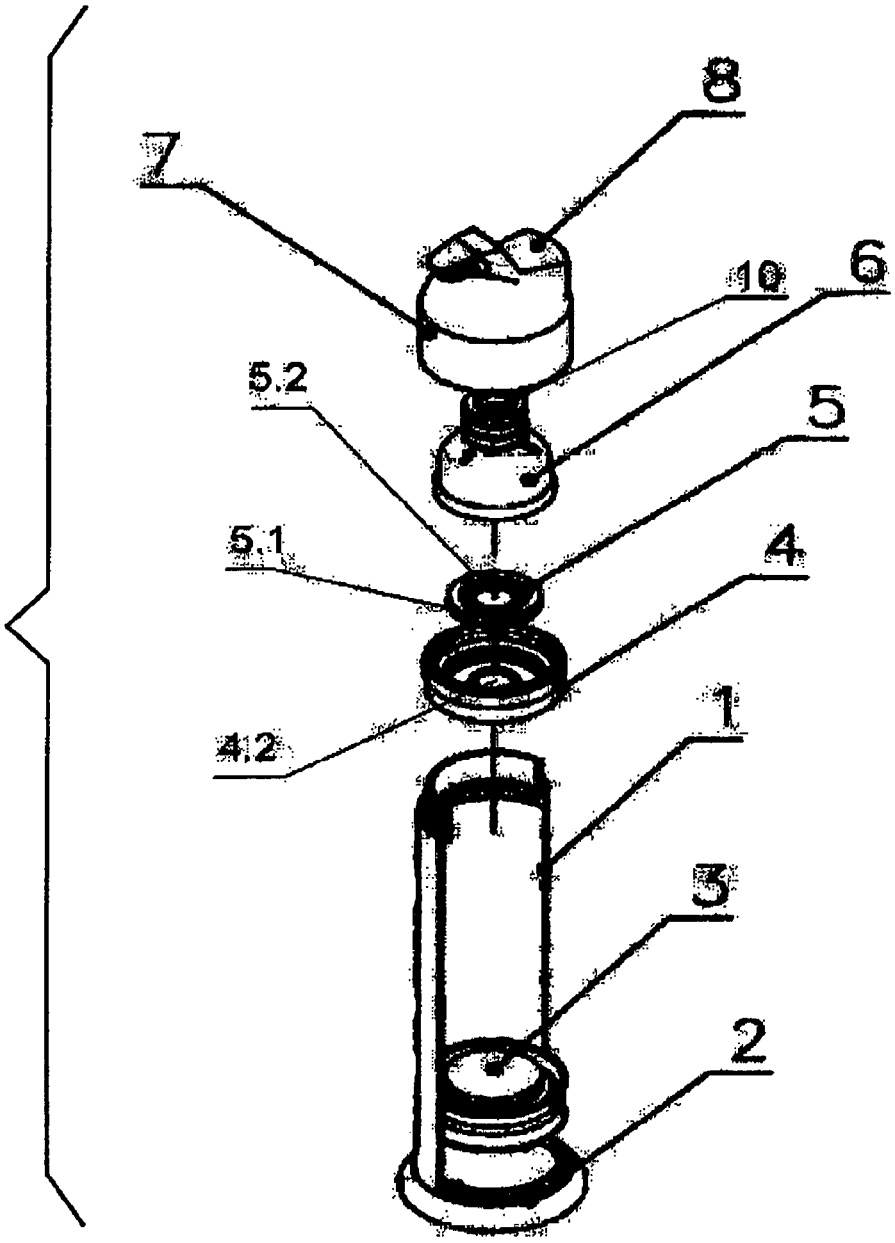
FIG. 2 is an exploded view of the present invention.
Figure 6:
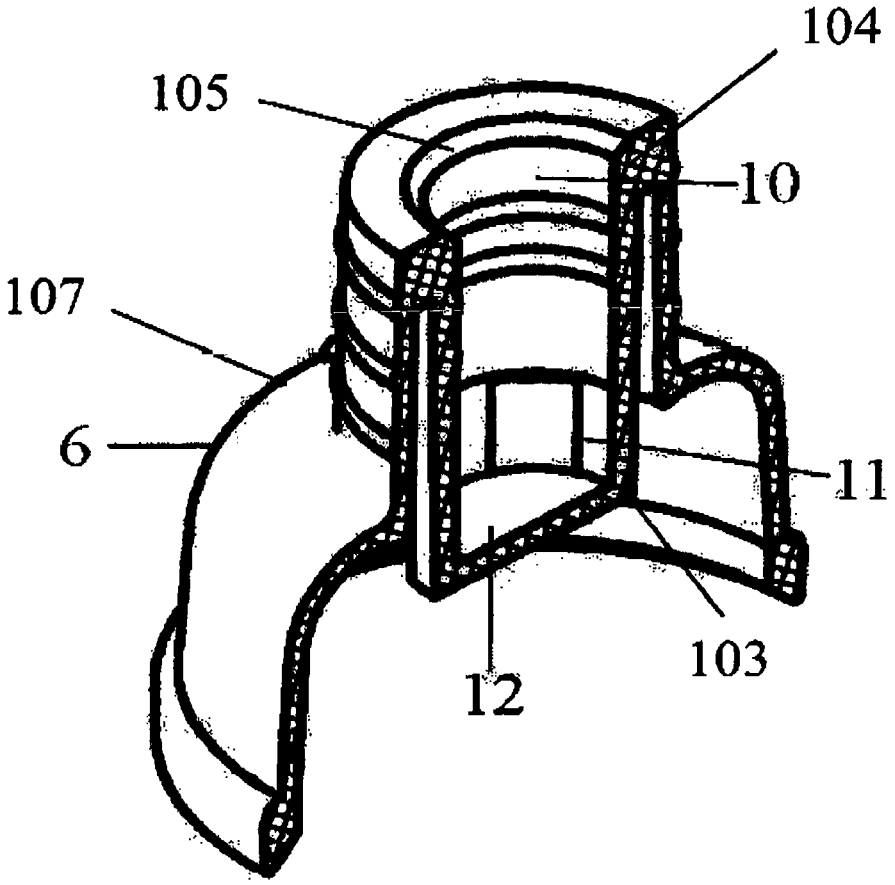
FIG. 6 is a cut-away view of the upper seal assembly of the present invention.
Figure 7:
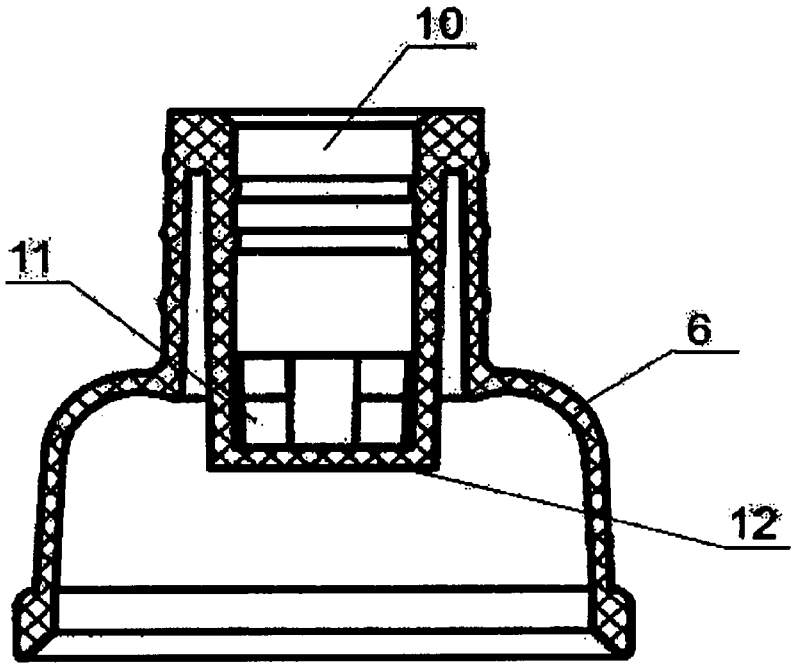
FIG. 7 is a cross-sectional view of the upper seal assembly of the present invention.
Figure 8:
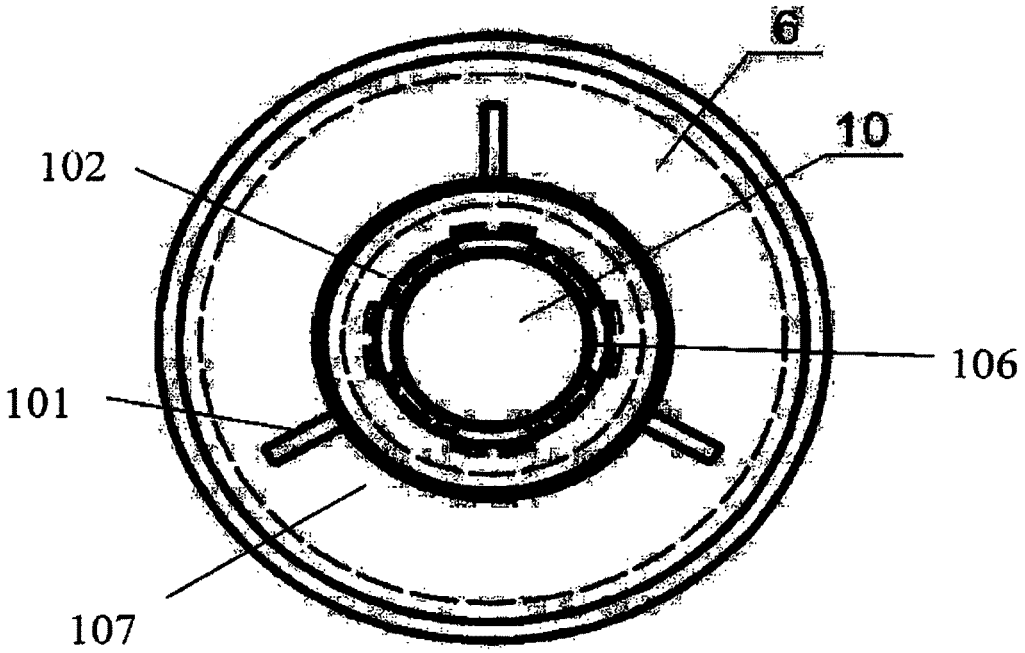
FIG. 8 is a top view of the upper seal assembly of the present invention.
Figure 9:
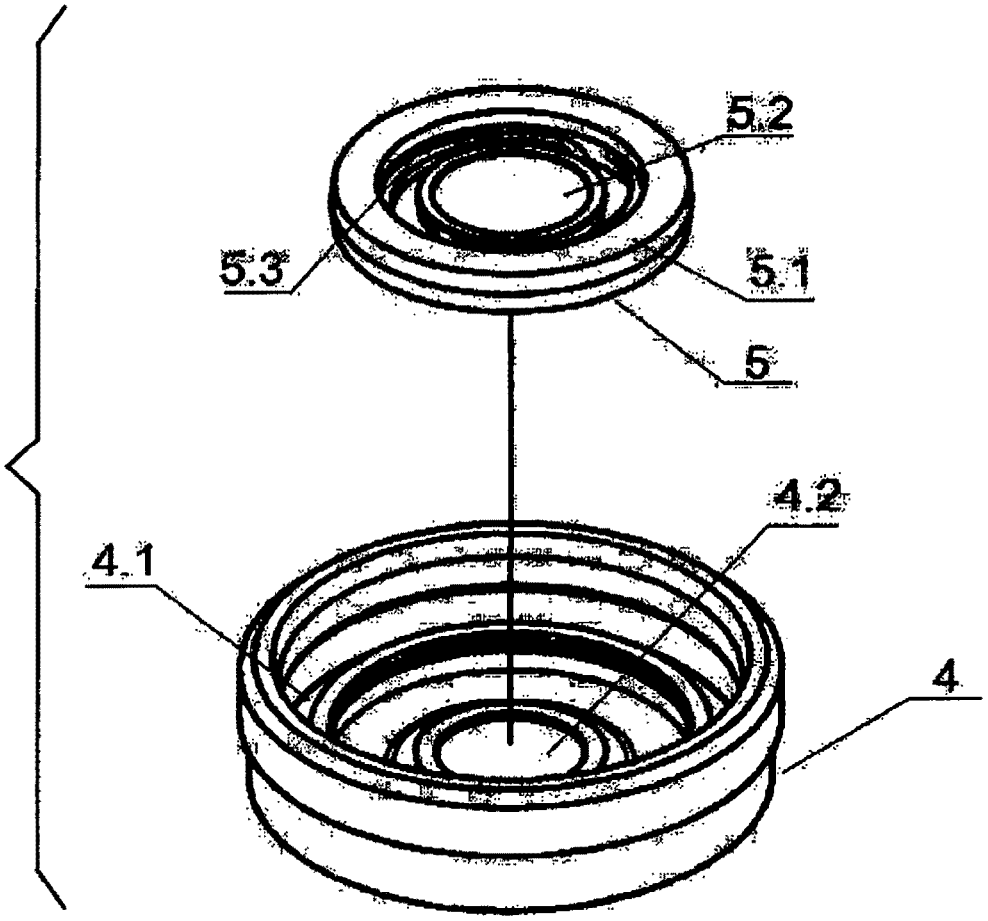
FIG. 9 is an exploded view of the lower seal assembly of the present invention.
Figure 10:
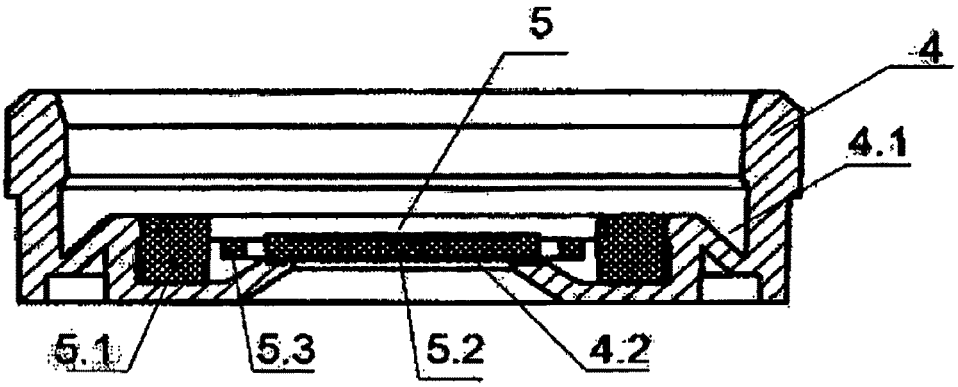
FIG. 10 is a cross-sectional view of the lower seal assembly of the present invention.

A self-priming-pump-equipped packaging bottle (as shown in FIG. 1 and FIG. 2) comprises a tubular bottle body 1, a piston 3 (as shown in FIG. 12-15), a pump head 7, a base 2, an upper seal assembly (as shown in FIGS. 6-8), and a lower seal assembly (as shown in FIG. 9-10). The piston 3 is installed at the lower part of the tubular bottle body 1, and is a sealing member having a waist-shaped cross-section, so that the piston 3 closely fits the inner wall of the tubular bottle body 1. The upper seal assembly is fixed to the upper part of the tubular bottle body 1, and lower seal assembly is fixed to the middle part of the tubular bottle body 1 between the piston 3 and the upper seal assembly. The upper seal assembly, the lower seal assembly, and the tubular bottle body 1 jointly form a closed material-feeding chamber, and the lower seal assembly, the piston 3, and the tubular bottle body 1 jointly form a closed material-storing chamber. The pump head 7 has a button 8 and a material outlet tube 9. The button 8 has its upper surface connected to a cap of the material outlet tube 9. The cap of the material outlet tube 9 closes the opening of the material outlet tube 9. The material outlet tube 9 is communicated with the hollow material-feeding column 10. The material outlet tube 9 has an outer diameter that is equal to the inner diameter of the hollow material-feeding column 10. The base 2 is provided with two through hole 4.2 that communicate the packaging bottle with the atmosphere.

Figure 11:
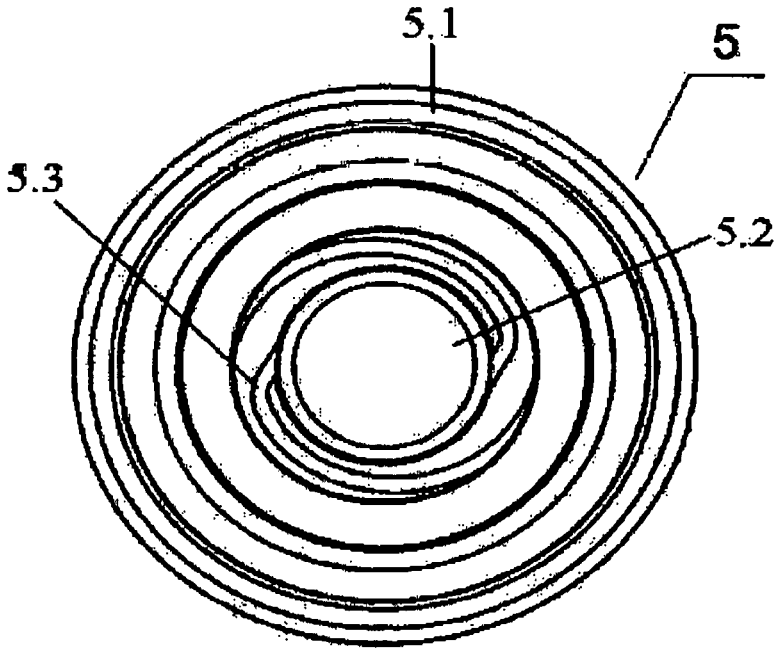
FIG. 11 is a top view of the elastic sealing gasket of the present invention.
Figure 12:
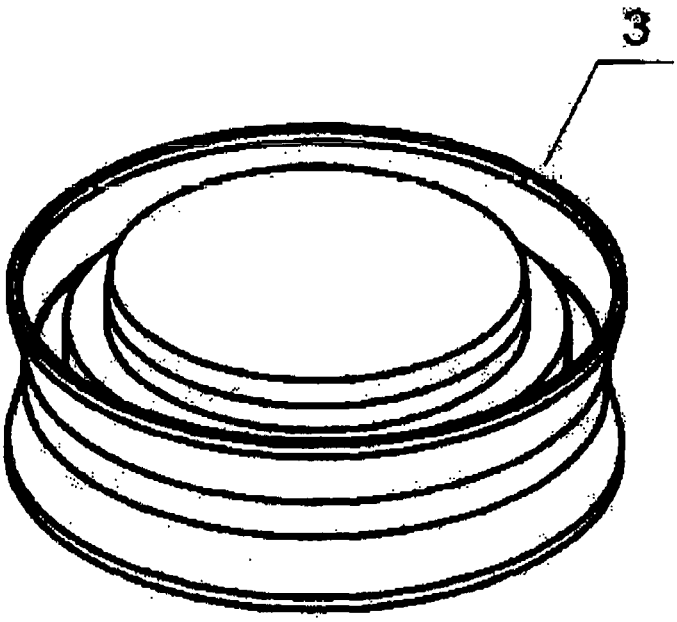
FIG. 12 is a perspective view of the piston of the present invention.
Figure 13:
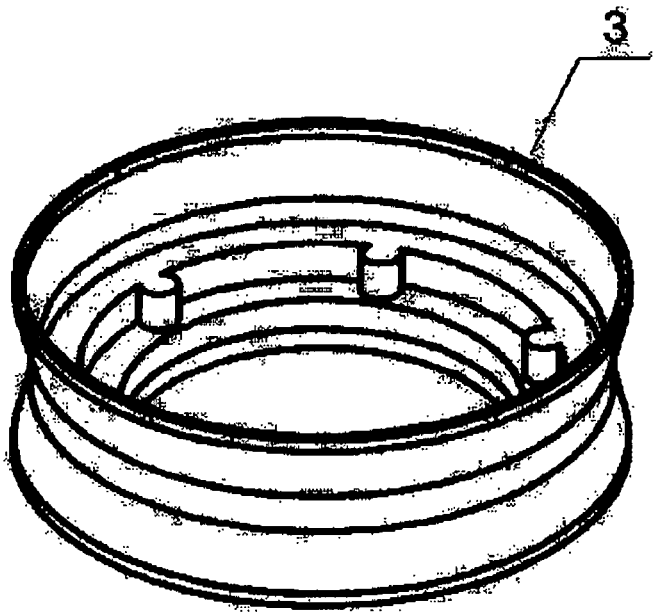
FIG. 13 is a perspective view of the piston of the present invention, wherein the piston is reversed.
Figure 14:
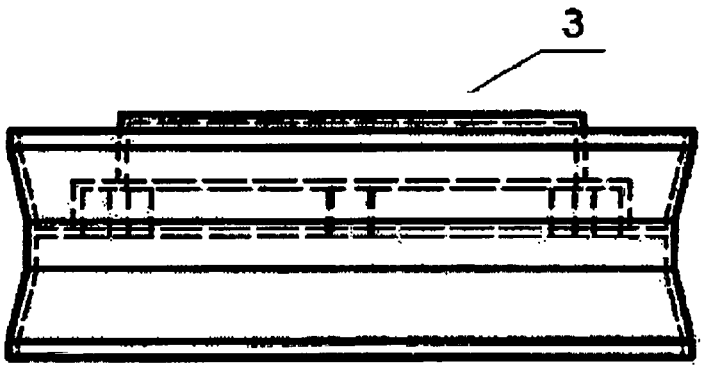
FIG. 14 is a front view of the piston of the present invention.
Figure 15:
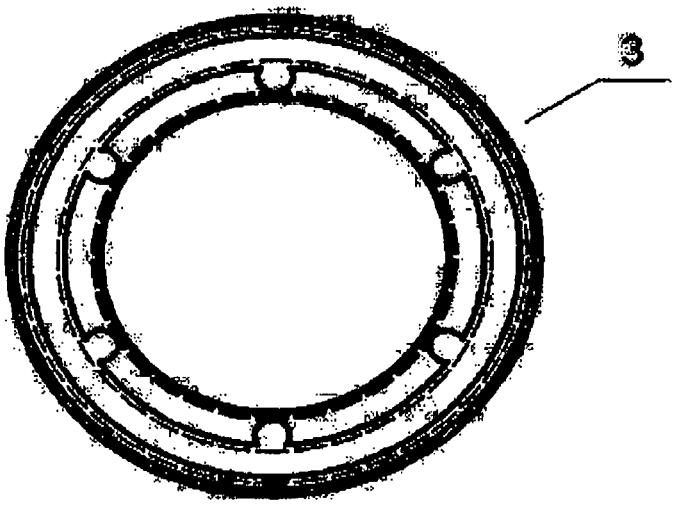
FIG. 15 is atop view of the piston of the present invention.

The lower seal assembly is primarily composed of a seal seat 4 and an elastic sealing gasket 5 (as shown in FIG. 11). The seal seat 4 has therein a circular recessed step 4.1, on which a through hole 4.2 is formed centrally to communicate the material-feeding chamber and the material-storing chamber. A centrally located elastic sealing gasket 5 covers the through hole 4.2 from the side corresponding to the material-feeding chamber. The seal plate 5.2 is greater than the through hole 4.2 in terms of size. The seal seat 4 is fixedly connected to the tubular bottle body 1, the elastic sealing gasket 5 is composed by a circular ring 5.1 having a rectangular physical cross-section, a seal plate 5.2 that is located at a center of the circular ring 5.1 and shaped as a round plate, and a connecting strip 5.3 that is shaped as a curved band and connects the circular ring 5.1 and the seal plate 5.2. The connecting strip 5.3 has a radius of arc that is 2-5 mm greater than a radius of circle of the seal plate 5.2. The circular ring 5.1, the seal plate 5.2, and the connecting strip 5.3 are integrated as a unity. A joint between the connecting strip 5.3 and the seal plate 5.2 is a bend. The seal plate 5.2 is smaller than the circular ring 5.1 in terms of thickness.

The upper seal assembly is primarily composed of an umbrella-shaped member 6, a hollow material-feeding column 10, a support post 11 and an end sealing cap 12, The end sealing cap 12 is fixed inside the umbrella-shaped member 6 by means of the support post 11. The hollow material-feeding column 10 has its outer wall 106 closely fitting the support post 11 and extending inward from the opening 105 at the upper end of the umbrella-shaped member 6. The hollow material-feeding column 10 has its bottom surface, together with the support post 11 and the end sealing cap 12, forming a material outlet. The edge of the opening at the lower end of the umbrella-shaped member 6 forms interference fit with the circular recessed step 4.1 of the seal seat 4, The umbrella-shaped member 6 is an elastic member. The upper part is of a hollow columnar structure, and the lower part is of an umbrella-shaped structure. The umbrella-shaped structure has three ribs 101 formed at its top surface 107. The hollow material-feeding column 10 has its height smaller than the length of the support post 11. The support post 11 includes four evenly distributed studs 102. Each of the studs 102 has one end 103 connected to the end sealing cap 12 and an opposite end 104 connected to the opening 105 at the upper end of the umbrella-shaped member 6. The umbrella-shaped member 6, the hollow material-feeding column 10, the support post 11, and the end sealing cap 12 are of an integrated structure.

Figure 3:
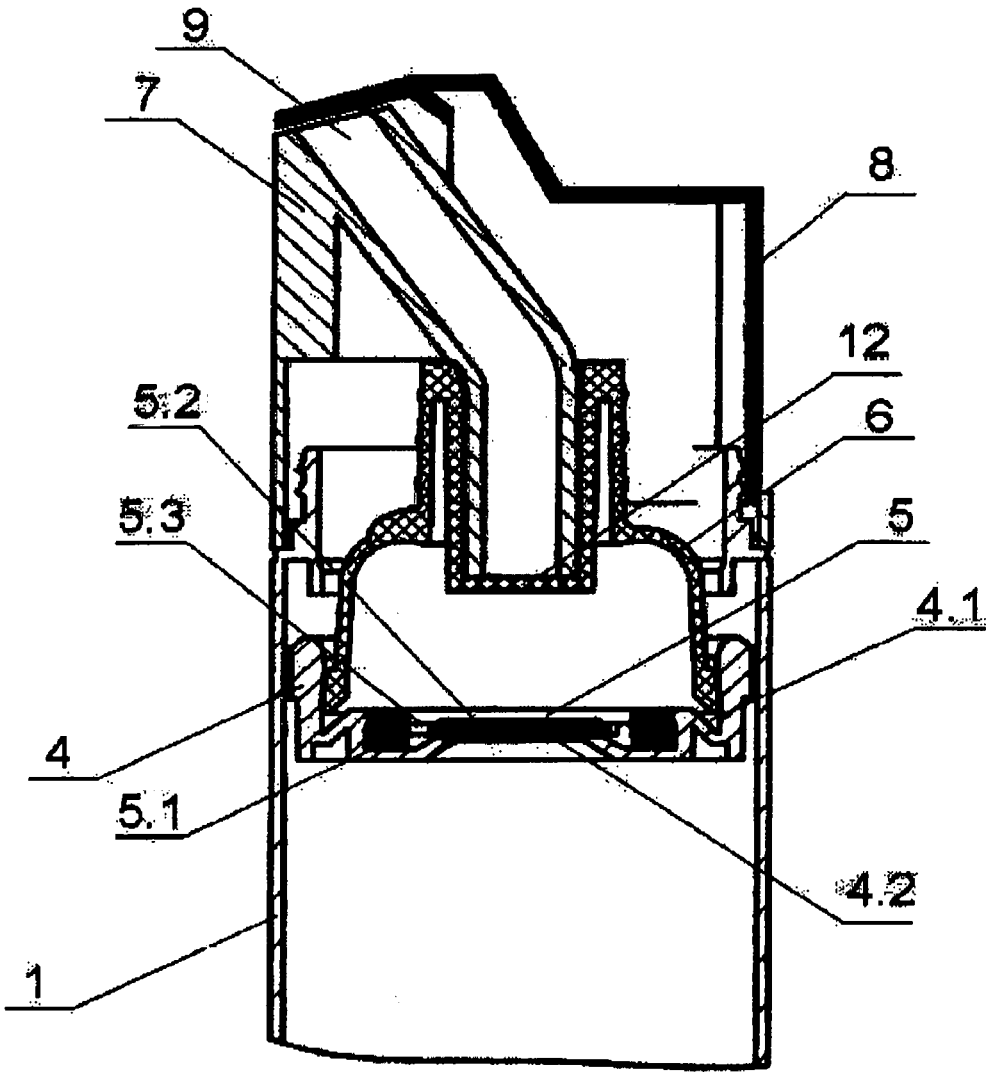
FIG. 3 is a partial, cross-sectional view of the present invention in its initial state.

As shown in FIG. 3, in an initial state, the cap of the material outlet tube 9 that is connected to the upper surface of the button 8 closes the opening of the material outlet tube 9. In the upper seal assembly, the end sealing cap 12 inside the umbrella-shaped member 6 closely fits the bottom of the material outlet tube 9, so that the material outlet is blocked. In the lower seal assembly, the elastic sealing gasket 5 naturally lies on the through hole 4.2 of the seal seat 4, so that the material-storing chamber is isolated from the material-feeding chamber.

Figure 4:
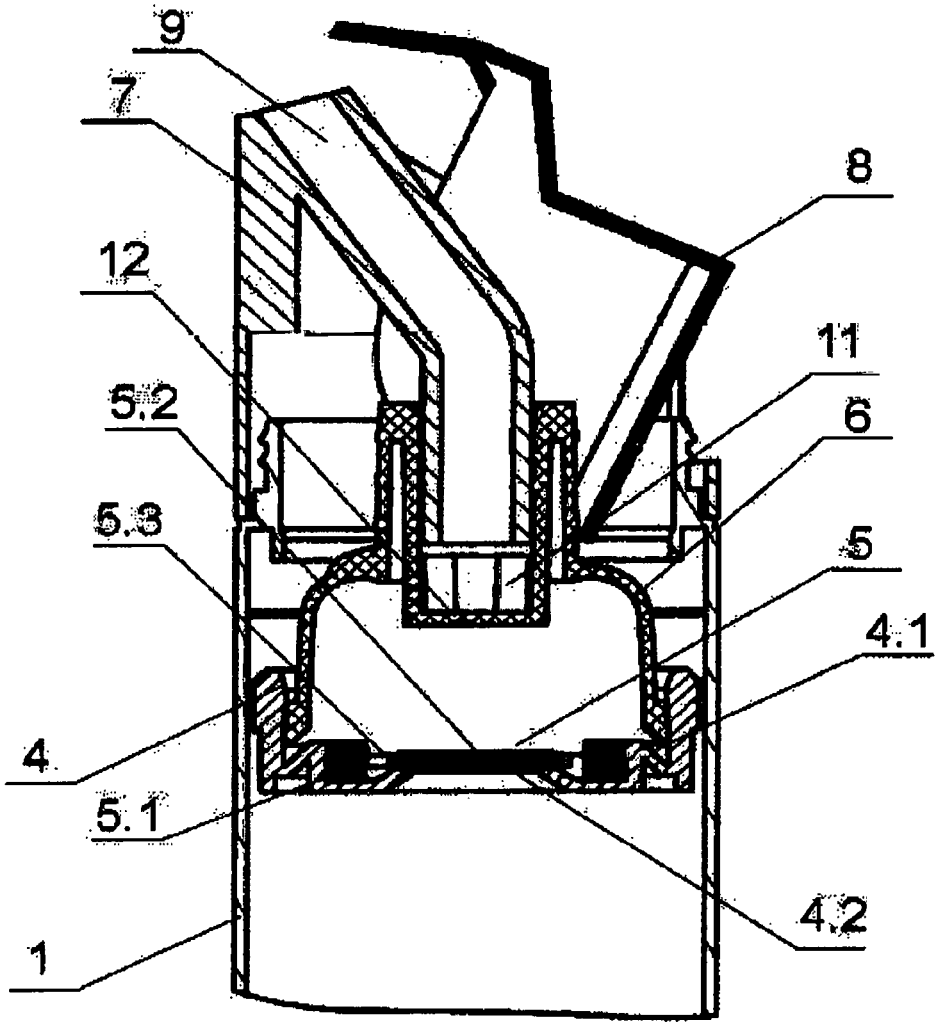
FIG. 4 is a partial, cross-sectional view of the present invention when the button is pressed.

As shown in FIG. 4, in use, when the button 8 of the pump head 7 is pressed, the cap of the material outlet tube 9 connected to the upper surface of the button 8 is opened, and the applied pressure acts on the umbrella-shaped member 6 through the button 8. As a result, the umbrella-shaped member 6 deforms in the direction where the pressure is applied, making the end sealing cap 12 of the umbrella-shaped member 6 move downward, so that the bottom of the material outlet tube 9 and the end sealing cap 12 become separated from their original close-fit status, and the material outlet is opened. At this time, the material in the material-feeding chamber is extruded through the material outlet, the hollow material-feeding column 10, and the material outlet tube 9. Meanwhile, the deformation of the umbrella-shaped member 6 makes the seal plate 5.2 in the elastic sealing gasket 5 move downward, thereby seating the through hole 4.2 of the seal seat 4, and isolating the material-storing chamber from the material-feeding chamber.

Figure 5:
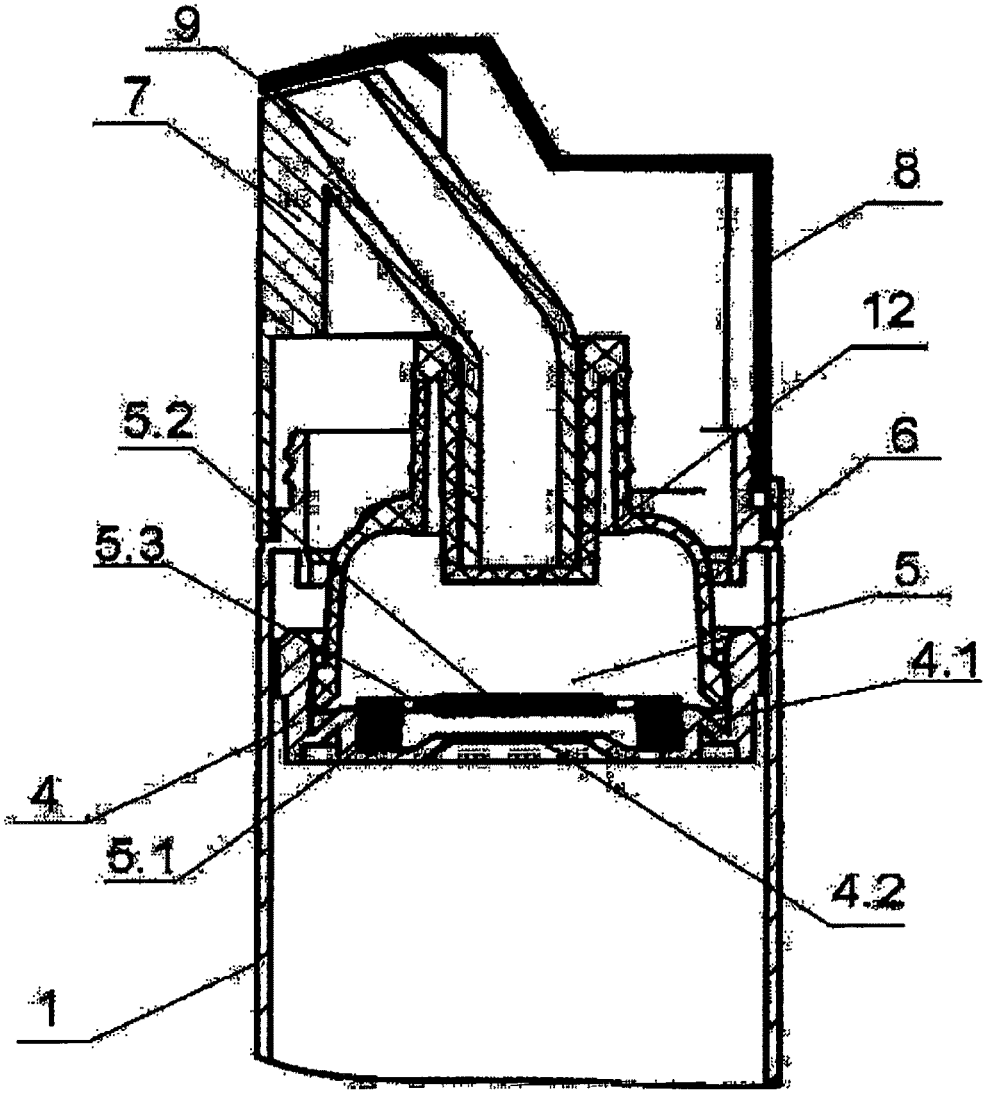
FIG. 5 is a partial, cross-sectional view of the present invention when the button is released.

As shown in FIG. 5, when the button 8 is released, the cap of the material outlet tube 9 closes the opening of the material outlet tube 9 again, and the umbrella-shaped member 6, which is now freed from the compression, performs deformation recovery. As a result, the umbrella-shaped member 6 moves upward, and the bottom of the material outlet tube 9 closely fits the end sealing cap 12 again to block the material outlet. At this time, negative pressure occurs in the material-feeding chamber, and makes the seal plate 5.2 in the elastic scaling gasket 5 move upward. Consequently, the through hole 4.2 of the seal seat 4 is opened, and material enters the material-feeding chamber from the material-storing chamber via the through hole 4.2. In this process, the piston 3 moves upward with the material. When the air pressure in the material-storing chamber and the air pressure in the material-feeding chamber become balanced, the piston 3 stops moving. After being still for a period of time, the seal plate 5.2 in the elastic sealing gasket 5 is pulled to return by the connecting strip 5.3, so that the elastic sealing gasket 5 naturally closes the seal seat 4, and the entire device returns to its initial state.

What is claimed is:

1. A self-priming-pump-equipped packaging bottle, comprising: a tubular bottle body, a piston, an upper seal assembly, and a lower seal assembly; the piston being installed in a lower part of the tubular bottle body; the upper seal assembly being fixed in an upper part of the tubular bottle body; the lower seal assembly being fixed in a middle part of the tubular bottle body between the piston and the upper seal assembly; the upper seal assembly, the lower seal assembly and the tubular bottle body jointly forming a closed material-feeding chamber; and the lower seal assembly, the piston, and the tubular bottle body jointly forming a closed material-storing chamber;

the lower seal assembly including a seal seat and an elastic sealing gasket, the seal seat having a through hole communicating the material-feeding chamber and the material-storing chamber, the elastic scaling gasket covering the through hole from a side corresponding to the material-feeding chamber; and the seed seat is in connection with the tubular bottle body; and the upper seal assembly having an umbrella-shaped member, a hollow material-feeding column, a support post, and an end scaling cap; the end sealing cap being fixed inside the umbrella-shaped member through the support post; an outer wall of the hollow material-feeding column closely fitting the support post and extending inward from an opening at an upper end of the umbrella-shaped member; a bottom surface of the hollow material-feeding column, the support post, and the end sealing cap jointly forming a material outlet; and a lower end of the umbrella-shaped member being in interference fit with the seal seat; wherein the elastic sealing gasket includes a circular ring, a seal plate located at a center of the circular ring, and a connecting strip that connects the circular ring and the seal plate, in which the circular ring, the seal plate, and the connecting strip am integrated as a unit, and the seal plate is smaller than the circular ring in terms of thickness.

2. The self-priming-pump-equipped packaging bottle of claim 1, wherein the tubular bottle body is a tube-shaped bottle body, and the piston is a sealing member having a waist-shaped cross-section, in which the piston and an inner wall of the tubular bottle body closely fit.

3. The self-priming-pump-equipped packaging bottle of claim 1, wherein the circular ring has a rectangular physical cross-section, and the seal plate is a round plate, while the connecting strip is a curved band, in which the connecting strip has a radius of arc 2-5 mm greater than a radius of circle of the seal plate, and a joint between the connecting strip and the seal plate is a bend.

4. The self-priming-pump-equipped packaging bottle of claim 1, wherein the seal seat is provided therein with a circular recessed step that includes and has a circular ring fixed inside the seal seat, in which the through hole is centrally formed on the seal seat; and a seal plate of the elastic sealing gasket is located centrally, with the seal plate being greater than the through hole in size, and with the connection realized by interference fit or fixed connection.

5. The self-priming-pump-equipped packaging bottle of claim 1, wherein the umbrella-shaped member is an elastic body, whose upper part is of a hollow columnar structure, and whose lower part is of an umbrella-shaped structure, in which a top surface of the umbrella-shaped structure is provided with more than three ribs.

6. The self-priming-pump-equipped packaging bottle of claim 1, wherein the hollow material-feeding column has a height smaller than a length of the support post, and the support post includes four evenly distributed studs, in which each said stud has one end connected to the end sealing cap, and an opposite end connected to the opening at the upper end of the umbrella-shaped member, while the umbrella-shaped member, the hollow material-feeding column, the support post, and the end sealing cap are integrated as a unit.

7. The self-priming-pump-equipped packaging bottle of claim 1, wherein the interference fit between the lower end of the umbrella-shaped member and the seal seat is interference fit between an edge of an opening at the lower end of the umbrella-shaped member and a circular recessed step in the seal seat.

8. The self-priming-pump-equipped packaging bottle of claim 1, further comprising a pump head that includes a button and a material outlet tube, wherein an upper surface of the button is connected to a cap of the material outlet tube that covers an opening of the material outlet tube, in which the material outlet tube is connected to the hollow material-feeding column, and an outer diameter of the material outlet tube is equal to an inner diameter of the hollow material-feeding column.

9. The self-priming-pump-equipped packaging bottle of claim 1, wherein the self-priming-pump-equipped packaging bottle has a bottom thereof provided with a base that is provided with more than one through hole connecting the packaging bottle and the atmosphere.

* * * * *